United States Patent [19]

Cobb et al.

[11] 4,229,044

[45] Oct. 21, 1980

[54] CLEVIS-MOUNTED IMPACT RIPPER

[75] Inventors: Delwin E. Cobb; Richard E. Livesay, both of Peoria, Ill.

[73] Assignee: Caterpillar Tractor Co., Peoria, Ill.

[21] Appl. No.: 31,560

[22] Filed: Feb. 12, 1979

[51] Int. Cl.[3] ..... A01B 35/00

[52] U.S. Cl. ..... 299/37; 37/DIG. 18; 172/40; 172/677

[58] Field of Search ..... 299/14, 37, 36; 172/40, 172/677; 37/DIG. 18

[56] References Cited

U.S. PATENT DOCUMENTS

| | | | |
|---|---|---|---|
| 2,998,965 | 9/1961 | Larson | 172/677 |
| 3,336,082 | 8/1967 | Bodine | 172/40 X |
| 3,698,484 | 10/1972 | Kinnan | 37/DIG. 18 |
| 3,770,322 | 11/1973 | Cobb et al. | 172/40 X |
| 4,003,603 | 1/1977 | Stemler et al. | 299/37 |
| 4,070,064 | 1/1978 | Cobb et al. | 299/36 X |

FOREIGN PATENT DOCUMENTS

| | | | |
|---|---|---|---|
| 568708 | 11/1977 | U.S.S.R. | 172/40 |

*Primary Examiner*—Ernest R. Purser

*Attorney, Agent, or Firm*—Wegner, Stellman, McCord, Wiles & Wood

[57] ABSTRACT

An improved ripper assembly (10) wherein a ripper shank (19) is mounted to the beam (11) of a tractor by a clevis pin (22) so as to minimize side forces acting on the shank pin (25). The vertical axis of the clevis pin may be aligned with the distal end (34) of the ripper tip (21) and the horizontal axis (24) of the shank pivot pin (25). The impact surfaces (28,29) of the impacting mechanism (18) and shank (19) preferably define a plane of abutment in which lies a radius (30) from the horizontal shank pivot pin axis (24). This plane is further preferably accurately perpendicular to the ripper tip axis (31) extending perpendicularly to the radius (30). The arrangement provides a free pivoting action of the ripper assembly about the vertical axis of the clevis pin so as to effectively minimize side loads for improved extended life of the ripper assembly (10).

14 Claims, 2 Drawing Figures

24
25
11
16
17
26
18
27
23
22
30
28
19
31
21
29
20
G
34

CLEVIS-MOUNTED IMPACT RIPPER

TECHNICAL FIELD

This invention relates to earthworking machines and more specifically to impact rippers.

BACKGROUND ART

In one form of conventional earth ripper, a ripper tip is mounted to a shank which is pivotally mounted to the tractor beam by a shank pivot pin. As a result of side loads acting on the ripper during the ripping operation, the shank pivot pins have worn so that the pins, at times, were lost during the ripping operation, presenting serious safety and maintenance problems.

A number of different pivoting arrangements have been utilized in connection with such ripping devices. Illustratively, in U.S. Pat. No. 2,797,629 of Carlton O. Kelly, a pivoted shank subsoil contour plow is shown wherein the distal tips of the plow blades are disposed directly below and in vertical alignment with the pivot pin mounting the blades to a frame member so as to prevent side draft at the tips of the plows.

Donald J. Larson, in U.S. Pat. No. 2,998,965, which patent is owned by the assignee hereof, shows a push block for a tractor-mounted ripper mounted to a tractor by a pair of draft arms. The ripper shank is provided with a ripper tip and connected with the tractor beam by a clevis pivotally connected to the beam by a clevis pin. The ripper tip is spaced substantially rearwardly of the axis of the clevis pin.

In U.S. Pat. No. 3,031,175 of Mack Wooldridge, a ripper mounting for twin crawlers is shown wherein the ripper tip is spaced rearwardly of the vertical axis of the clevis pin.

Albert G. Bodine shows a sonic rectifier coupling for rock cutting apparatus in U.S. Pat. No. 3,367,716, wherein an impact device is engageable with an impact surface of the ripper shank at an angle thereto.

In U.S. Pat. No. 3,770,322, Delwin E. Cobb et al show an apparatus for fracture of material in situ with stored inertial energy which is cyclically delivered on demand to the work tool, and which energy is stored in a large flywheel and delivered to the tool by suitable transmission means. The single pivot point disclosed by Cobb et al is indicated as preferably located ahead of the cutting tip to obtain the desired motion.

Darrel M. Wooldridge, in U.S. Pat. No. 4,044,838, shows an automatic control for a ripper tool which is disposed substantially rearwardly of the majority of the mounting pins of the assembly.

DISCLOSURE OF INVENTION

The present invention is directed to overcoming one or more of the problems as set forth above.

The present invention comprehends an improved ripper structure utilizing an impact energy source mounted at the rear of an earthmoving machine, such as a tractor.

The impact ripper assembly is mounted to the beam of the tractor by a clevis-type mounting.

In the illustrated embodiment, the ripper shank is pivoted from a point located on a line parallel to the impact surface and substantially above the surface.

Further, in the illustrated embodiment, the shank pivot pin axis is disposed substantially vertically above the distal tip of the ripper.

Still further in the illustrated embodiment, the shank pivot pin axis is disposed substantially in intersecting relationship to the vertical axis of the clevis pivot pin pivotally mounting the assembly to the beam for swinging movement about a vertical axis so as to provide limited side-to-side movement of the ripper in normal operation thereof.

The ripper includes a rock breaker mechanism for providing desirable impact forces to the ripper tip in the earthworking operation with the impact surface of the hammer of the rock breaker mechanism being accurately in parallel abutting relationship to the impact surface of the ripper tip shank at the point of impact in the operation of the apparatus.

In the illustrated embodiment, the abutment of the impact surfaces defines a plane extending perpendicularly transversely to the ripper tip axis and in which lies a radius from the shank pivot pin axis extending perpendicularly to the ripper tip axis.

Thus, the present structure effectively minimizes wear of the shank pivot pin to provide long trouble-free life of the ripper assembly mounting to the tractor beam. The ripper structure of the present invention is extremely simple and economical of construction while yet providing the highly desirable features discussed above.

BEST MODE FOR CARRYING OUT THE INVENTION

Figure 1:
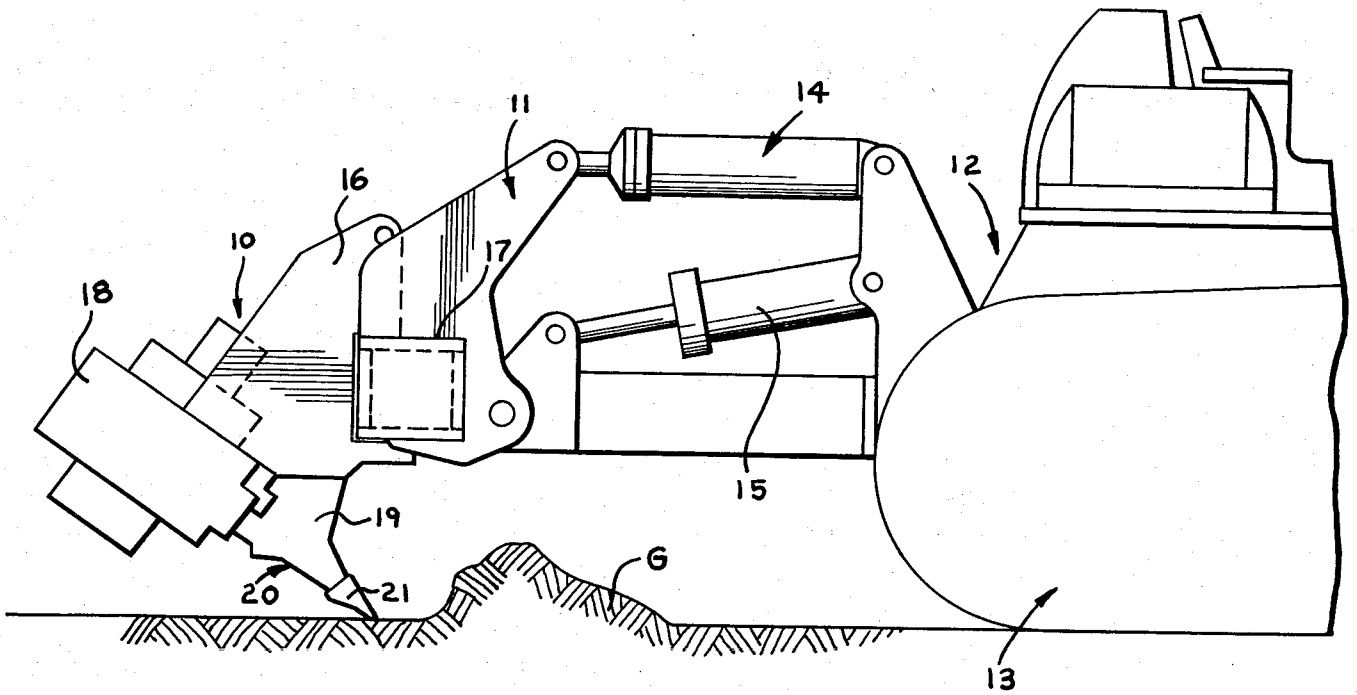
FIG. 1 is a fragmentary side elevation of an earthworking apparatus including a ripper structure embodying the invention.

In the exemplary embodiment of the invention as disclosed in the drawing, a ripper assembly generally designated 10 is shown as mounted to a beam generally designated 11 mounted on the rear portion 12 of a tractor 13. The tractor includes suitable extensible elements 14 and 15, such as hydraulic cylinder devices, for controlling the disposition of the beam and, thus, the positioning of the ripper assembly in the operation thereof. The invention is concerned with the mounting of the ripper assembly 10 to the beam 11 and, in the arrangement of the elements of the ripper assembly relative to such mounting, to provide an improved long life, troublefree operation.

More specifically, as seen in FIG. 1, the ripper assembly 10 includes a bracket 16 mounted to the beam 11 by a clevis 17. The bracket carries a rock breaker mechanism 18 for providing an impact force to the shank 19 of a ripper generally designated 20 and provided at its lower end with a ripper tip 21. In normal operation, as the tractor is moved forwardly to draw the ripper into the ground G to be ripped, the tip 21 is impacted by the mechanism 18 so as to provide an improved rock breaking ripping operation for facilitated earth working.

Figure 2:
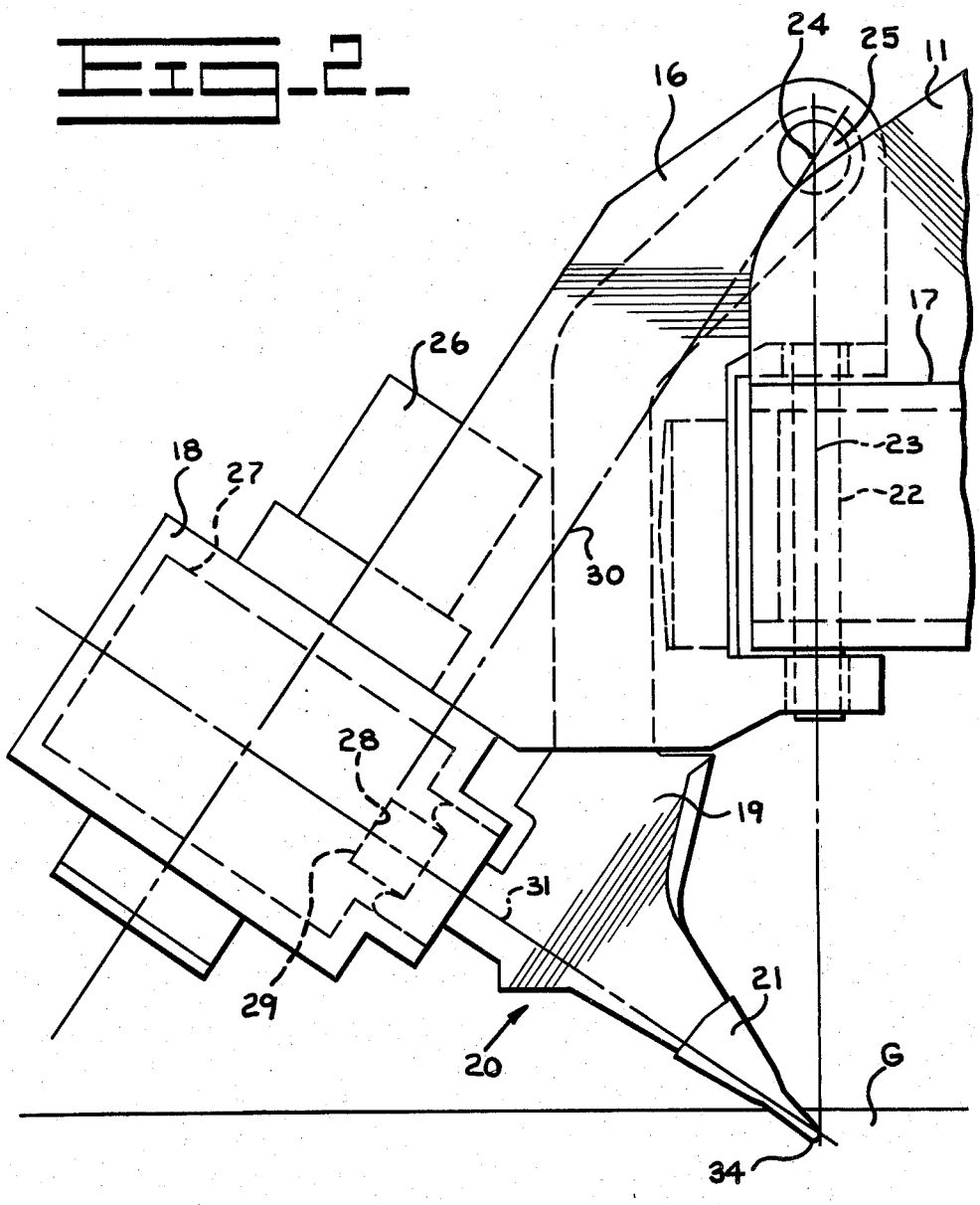
FIG. 2 is a fragmentary enlarged side elevation of the ripper structure.

Referring now more specifically to FIG. 2, the structural arrangement of the ripper assembly may be more clearly seen. As shown, the clevis is provided with a clevis pin 22 which is arranged to define a substantially vertical axis 23 extending downwardly vertically to the distal end 34 of the ripper tip 21. The clevis pin axis extends vertically upwardly to perpendicularly intercept a horizontal axis 24 of a shank pivot pin 25 pivotally mounted to the bracket 16 and carrying the shank 19 for pivotal swinging about the axis 24. Thus, the ripper tip 21 is positionable about the vertical axis 23 of the clevis pivot and, in the illustrated embodiment, is swingable thereabout approximately 30°, i.e., 15° in each direction from the centered disposition. Concurrently, the ripper tip 21 is swingable about the horizontal axis 24, and more specifically, is arranged to provide an impact ripping action as a result of the impact forces generated thereon by the rock breaker mechanism 18 so as to provide a desired ripping force downwardly into the ground G, as shown in FIG. 2 in the normal operation of the ripper assembly.

The impact force applying means may comprise a conventional rock breaker mechanism which may include a conventional operating motor 26. The motor drives a conventional flywheel-crankshaft ring impactor 27 well known to those skilled in the art and, thus, no further description thereof need be given here. However, the impactor device defines an impact surface 28 which impinges on a reaction impact surface 29 of the shank 19 in the impacting operation so as to apply an impact force to the shank so as to impact the ripper tip 21 into the ground G, as illustrated in FIG. 2.

As shown in FIG. 2, the surfaces 28 and 29 are accurately parallel so as to define a common plane when in abutment with each other, which plane contains a radius 30 from the horizontal shank pivot pin axis 24 extending perpendicular to the axis 31 of the ripper tip 21.

Thus, the invention comprehends mounting the ripper assembly 10 to the beam 11 by means of an improved connection including the clevis pin 22 axially vertically aligned with the distal end 34 of the ripper tip 21. The horizontal shank pin axis, within the scope of the invention, is disposed to substantially intersect the vertical clevis pin axis 23.

It is further contemplated within the scope of the invention that the impact surfaces be accurately parallel so as to define a common plane when in abutment in the impacting operation, which plane defines a radius 30 of the shank pivot pin axis 24 and which perpendicularly intersects the ripper tip axis 31 which extends perpendicularly to the radius 30.

As discussed above, the vertical clevis pivot pin axis 23 is preferably vertically aligned with the distal end 34 of the ripper tip and the horizontal axis 24 of the shank pivot pin. The invention comprehends that within the concept of substantial alignment thereof, the axis of the clevis pivot pin 22 may be disposed somewhat forwardly of this line in providing the desired force moment to assure turning of the unit into the rocks, etc. of the ground G with effectively minimized side forces tending to wear the pivot pins of the device.

In the illustrated embodiment, the impact surfaces, 28 and 29 are disposed at a 35° angle to the horizontal. Such disposition has been found to provide an excellent impacting operation which, when combined with the improved reduction of side forces acting on the shank pin, provides a long, highly efficient, troublefree life of the ripper assembly.

INDUSTRIAL APPLICABILITY

As indicated above, the ripper structure of the present invention may be utilized as an impact energy source, such as mounted at the rear of an earthmoving machine. One form of machine with which the ripper structure may be advantageously utilized is a tractor.

Further more specifically, the ripper assembly may be mounted to the beam of the tractor as by clevis-type mounting.

The impact ripper may be utilized as a conversion unit wherein a conventional rockbreaker device is converted to an impact rock trencher. The apparatus, when utilized in producing trenches, advantageously produced vertical sidewalls and efficiently operated as an impact rock cruncher.

Other aspects, objects and advantages of this invention can be obtained from a study of the drawings, the disclosure and the appended claims.

We claim:

1. In a ripper assembly (10) having a beam (11) adapted to be secured to an earthworking machine, a clevis pivot pin (22) mounted to said beam to define a vertical pivot axis (23), am impact breaker mechanism (18), a shank (19) provided with a shank pivot pin (25), a ripper tip (21) defining a ripper tip axis (31), and a bracket (16) pivotally mounted to the clevis pivot pin (22) and carrying the impact breaker mechanism (18) to apply an impact force to the shank (19) urging the ripper tip (21) about the axis (24) of the shank pivot pin (25), the improvement comprising means on said bracket (16) for mounting said shank pivot pin (25) to define a horizontal pivot axis (24) substantially intersecting said clevis pivot pin vertical axis (23).

2. The ripper assembly of claim 1 wherein said clevis pivot pin axis (23) substantially intersects the distal end (34) of the ripper tip (21).

3. The ripper assembly of claim 1 wherein said impact breaker mechanism is swingable about said shank pin axis (24) and said shank (19) defines an impact surface (29) extending perpendicularly to the ripper tip axis (31), said mechanism defining an impact means (18) impacting against said impact surface (29) accurately perpendicularly to said ripper tip axis (31).

4. The ripper assembly of claim 1 wherein said impact breaker mechanism is swingable about said shank pin axis (24) and said shank (19) defines an impact surface (29) extending perpendicularly to the ripper tip axis (31), said mechanism defining an impact means (18) impacting against said impact surface (29) accurately perpendicularly to said ripper tip axis, said impact surface (29) extending parallel to a radius (30) from said shank pivot pin axis (24) extending perpendicularly to said ripper tip axis (31).

5. The ripper assembly of claim 1 wherein said clevis pivot pin axis (23) substantially intersects the distal end (34) of the ripper tip (21), said impact breaker mechanism is swingable about said shank pin axis (24) and said shank (19) defines an impact surface (29) extending perpendicularly to the ripper tip axis (31), said mechanism defining an impact means (18) impacting against said impact surface (29) accurately perpendicularly to said ripper tip axis (31).

6. The ripper assembly of claim 1 wherein said clevis pivot pin axis (23) substantially intersects the distal end (34) of the ripper tip (21), said impact breaker mechanism is swingable about said shank pin axis (24) and said shank (19) defines an impact surface (29) extending perpendicularly to the ripper tip axis (31), said mechanism defining an impact means (18) impacting against said impact surface (29) accurately perpendicularly to said ripper tip axis, said impact surface (29) extending parallel to a radius (30) from said shank pivot pin axis

(24) extending perpendicularly to said ripper tip axis (31).

7. In a ripper assembly (10) having a beam (11) adapted to be secured to an earthworking machine, a clevis pivot pin (22), an impact breaker mechanism (18), a shank (19) provided with a shank pivot pin (25), a ripper tip (21) defining a ripper tip axis (31) and defining a distal end (34), and a bracket (16) pivotally mounted to the clevis pivot pin (22) and carrying the impact breaker mechanism (18) to apply an impact force to the shank (19) urging the ripper tip (21) about the axis (24) of the shank pivot pin (25), the improvement comprising:

means on said bracket (16) for mounting said shank pivot pin (25) to define a horizontal pivot axis (24) substantially vertically above the ripper tip (21); and means for mounting said clevis pivot pin (22) to said beam (11) to define a vertical pivot axis (23) substantially intersecting said distal end (34) of the ripper tip (21).

8. The ripper assembly of claim 7 wherein said shank defines an impact surface 29 extending parallel to a radius (30) from said shank pivot pin axis (24) extending perpendicularly to said ripper tip axis (31).

9. In a ripper assembly (10) having a beam (11) adapted to be secured to an earthworking machine, a clevis pivot pin (22) mounted to said beam to define a vertical pivot axis (23), an impact breaker mechanism (18), a shank (19) provided with a shank pivot pin (25), a ripper tip (21) defining a ripper tip axis (31), and a bracket (16) pivotally mounted to the clevis pivot pin (22) and carrying the impact breaker mechanism (18) to apply an impact force to the shank (19) urging the ripper tip (21) about the axis (24) of the shank pivot pin (25), the improvement comprising means defining planar, confronting impact force transfer surfaces (28,29) on said breaker mechanism (18) and shank (19) respectively arranged to extend transversely to said ripper tip axis (31), the abutment of said transfer surfaces defining a plane in which lies a radius (30) from said shank pivot pin axis (24) which pivot pin axis extends perpendicularly to said ripper tip axis (31).

10. The ripper assembly of claim 9 wherein said breaker mechanism (18) comprises means defining a first (28) of said force transfer surfaces (28,29) defining a plane containing at all times said radius (30).

11. The ripper assembly of claim 9 wherein said breaker mechanism (18) comprises means defining a first (28) of said force transfer surfaces (28,29) defining a plane containing at all times said radius and said shank (19) includes an anvil portion defining the other (29) of said surfaces (28,29), said other (29) of said surfaces defining a plane extending perpendicularly to said ripper tip axis (31) at all times.

12. The ripper assembly of claim 9 wherein said breaker mechanism (18) comprises means defining a first (28) of said force transfer surfaces (28,29) defining a plane containing at all times said radius and said shank (19) includes an anvil portion defining the other (29) of said surfaces (28,29), said other (29) of said surfaces defining a plane extending perpendicularly to said ripper tip axis (31) at all times, the line between the distal end (34) of the ripper tip (21) and said shank pivot pin axis (24) extending vertically.

13. The ripper assembly of claim 9 wherein said breaker mechanism (18) comprises means defining a first (28) of said force transfer surfaces (28,29) defining a plane containing at all times said radius and said shank (19) includes an anvil portion defining the other (29) of said surfaces (28,29), said other (29) of said surfaces defining a plane extending perpendicularly to said ripper tip axis (31) at all times, the line between the distal end (34) of the ripper tip (21) and said shank pivot pin axis (24) extending vertically and being substantially coincident with said clevis pivot pin axis (23).

14. The ripper assembly of claim 9 wherein said breaker mechanism (18) comprises means defining a first (28) of said force transfer surfaces (28,29) defining a plane containing at all times said radius and said shank (19) includes an anvil portion defining the other (29) of said surfaces (28,29), said other (29) of said surfaces defining a plane extending perpendicularly to said ripper tip axis (31) at all times, the line between the distal end (34) of the ripper tip (21) and said shank pivot pin axis (24) extending vertically and being substantially coincident with said clevis pivot pin axis (23), said shank (19) and breaker mechanism (18) being swingable as a unit approximately 30° about said clevis pivot pin axis (23).

* * * * *